US010731932B2

(12) United States Patent
Livni et al.

(10) Patent No.: US 10,731,932 B2
(45) Date of Patent: Aug. 4, 2020

(54) BLOCKING ELEMENTS FOR BALL TRAP SCREEN

(71) Applicant: C.Q.M. LTD, Kibbutz Givat Hashlosha (IL)

(72) Inventors: Zvi Livni, Tel Aviv (IL); Omer Livni, Hod HaSharon (IL); Udi Siboni, Kfar Saba (IL)

(73) Assignee: C.Q.M LTD, Kibbutz Givat Hashlosha (IL)

( * ) Notice: Subject to any disclaimer, the term of this patent is extended or adjusted under 35 U.S.C. 154(b) by 34 days.

(21) Appl. No.: 16/104,227

(22) Filed: Aug. 17, 2018

(65) Prior Publication Data

US 2018/0356170 A1 Dec. 13, 2018

Related U.S. Application Data

(63) Continuation-in-part of application No. 14/893,067, filed as application No. PCT/IL2014/050458 on May 22, 2014, now abandoned.

(60) Provisional application No. 61/826,027, filed on May 22, 2013.

(51) Int. Cl.

| | |
|---|---|
| ***F28G 1/12*** | (2006.01) |
| ***F28G 15/00*** | (2006.01) |
| ***B08B 9/057*** | (2006.01) |

(52) U.S. Cl.

CPC ..... *F28G 1/12* (2013.01); *B08B 9/057* (2013.01); *F28G 15/00* (2013.01)

(58) Field of Classification Search

CPC .. F28G 1/12; F28G 1/125; F16L 45/00; F16L 55/46; B08B 9/057

See application file for complete search history.

(56) References Cited

U.S. PATENT DOCUMENTS 3,174,171 A * 3/1965 McDermon ..... F16L 55/46 15/104.062
4,343,702 A * 8/1982 Riedel ..... F28G 1/12 210/391
4,343,703 A * 8/1982 Riedel ..... F28G 1/12 210/391
4,543,188 A * 9/1985 Okouchi ..... B01D 29/114 210/304

(Continued)

FOREIGN PATENT DOCUMENTS

JP 60044800 A * 3/1985 ..... F28G 1/12

*Primary Examiner* — Eric S Ruppert
*Assistant Examiner* — Hans R Weiland
(74) *Attorney, Agent, or Firm* — Mark M. Friedman

(57) ABSTRACT

A ball trap screen for use with "T" type ball traps having a ball trap extension in which the ball trap screen includes a cone shaped inlet; an elbow, at least a portion of which includes a substantially planer solid area; a first screen section extending between the cone shaped inlet and the elbow; and a second screen section extending from the elbow into the ball trap extension; wherein at least a portion of the cone shaped inlet includes a cone solid blocking element, the first screen section includes a first solid screen blocking element and the second screen section includes a second solid screen blocking element. A method of enhancing the movement of the cleaning ball through the ball trap by blocking portions of a ball trap screen deployed within a ball trap housing so as to modify the fluid flow through the ball trap.

11 Claims, 5 Drawing Sheets

(56) References Cited

U.S. PATENT DOCUMENTS

| | | | | |
|---|---|---|---|---|
| 4,680,113 | A * | 7/1987 | Eimer | B01D 29/01 210/181 |
| 6,223,809 | B1 * | 5/2001 | Schildmann | F28G 1/12 15/3.51 |
| 6,913,071 | B1 * | 7/2005 | Livni | B08B 9/057 15/3.51 |

* cited by examiner

BLOCKING ELEMENTS FOR BALL TRAP SCREEN

CROSS-REFERENCES TO RELATED APPLICATIONS

This application is related to and claims priority from commonly owned, U.S. patent application Ser. No. 14/893,067, entitled: Blocking Elements for Ball Trap Screen, filed on 22 Nov. 2015, the disclosure of which is incorporated by reference in its entirety herein.

FIELD AND BACKGROUND OF THE INVENTION

The present invention relates to ball traps used in heat exchanger cleaning system and, in particular, it concerns blocking elements for ball trap screens that enhances the movement of the cleaning ball through the ball trap.

It is known collect the cleaning balls use to clean closed fluid flow systems such as heat exchangers in a ball trap and then drawn from the ball trap into a ball collection chamber. Ball traps may be configured at to extend from the main flow pipe at substantially any angle.

Currently it is increasingly popular to utilize a ball trap that extends from the main fluid flow pipe at a 90° angle, such a ball trap is commonly referred to as a "T" type ball trap (10 in the drawings).

Such ball traps are generally configured with a screen or sieve element 100 that extends from the inlet opening 12 of the "T" into the ball trap itself.

The present inventors have found that the "T" type balls traps currently in use are ineffectual at collecting all of the cleaning balls in the system. That is to say, the fluid flow patterns in the "T" type ball traps currently in use cause some of the cleaning balls to congregate in regions of the screen from which they are not drawn out of the ball trap into the ball collection chamber.

SUMMARY OF THE INVENTION

The present invention is blocking elements for ball trap screens that enhance the movement of the cleaning ball through the ball trap.

According to the teachings of the present invention there is provided, a ball trap screen for use with "T" type ball traps having a ball trap extension, the ball trap screen comprising: a cone shaped inlet; an elbow, at least a portion of which includes a substantially planar solid area configured so as to block fluid flow through the ball trap screen across all of the planar solid area; a first screen section extending between the cone shaped inlet and the elbow; and a second screen section extending from the elbow into the ball trap extension; wherein at least a portion of the cone shaped inlet includes a cone solid blocking element, the first screen section includes a first solid screen blocking element and the second screen section includes a second solid screen blocking element wherein the cone solid blocking element, the first solid screen blocking element and the second solid screen blocking element are configured so as to block fluid flow through corresponding regions of the ball trap screen.

According to the teachings of the present invention the elbow is configured as a 90° elbow.

According to the teachings of the present invention the first solid screen blocking element and the second solid screen blocking elements are deployed so as to substantially circumscribe the planar solid area of the elbow.

According to the teachings of the present invention the cone solid blocking element, the first solid screen blocking element and the second solid screen blocking element are integrally formed with the ball trap screen.

According to the teachings of the present invention the cone solid blocking element, the first solid screen blocking element and the second solid screen blocking element are individually formed and deployed on the ball trap screen.

There is also provided according to the teaching of the present invention a ball trap for collecting cleaning balls, the ball trap comprising: a ball trap housing with a water inlet opening, a water outlet and a ball trap extension; a ball trap screen having at least a: a cone shaped inlet; an elbow, at least a portion of which includes a substantially planar solid area configured so as to block fluid flow through the ball trap screen across all of the planar solid area; a first screen section extending between the cone shaped inlet and the elbow; and a second screen section extending from the elbow into the ball trap extension; wherein at least a portion of the cone shaped inlet includes a cone solid blocking element, the first screen section includes a first solid screen blocking element and the second screen section includes a second solid screen blocking element wherein the cone solid blocking element, the first solid screen blocking element and the second solid screen blocking element are configured so as to block fluid flow through corresponding regions of the ball trap screen.

There is also provided according to the teaching of the present invention blocking elements for a ball trap screen, the blocking elements comprising: a cone solid blocking element configured for deployment on a cone shaped inlet of the ball trap screen, so as to block fluid flow through a corresponding region of the ball trap screen; a first solid screen blocking element configured for deployment on a first screen section of the ball trap screen, so as to block fluid flow through a corresponding region of the ball trap screen; and a second solid screen blocking element configured for deployment on a second screen section of the ball trap screen, so as to block fluid flow through a corresponding region of the ball trap screen.

According to the teachings of the present invention the first solid screen blocking element and the second solid screen blocking element are configured for deployment so as to substantially circumscribe a planar solid area of an elbow of the ball trap screen.

There is also provided according to the teaching of the present invention a method of enhancing the movement of the cleaning ball through the ball trap of a closed fluid flow system by blocking a flow of fluid through portions of a ball trap screen deployed within a ball trap housing so as to modify the fluid flow through the ball trap, the method comprising: deploying a cone solid blocking element on a cone shaped inlet of the ball trap screen, the cone solid blocking element configured so as to block fluid flow through a corresponding region of the cone shaped inlet; deploying a first solid screen blocking element on a first screen section of the ball trap screen, the first solid screen blocking element configured so as to block fluid flow through a corresponding region of the first screen section; deploying a second solid screen blocking element on a second screen section of the ball trap screen, the second solid screen blocking element configured so as to block fluid flow through a corresponding region of the second screen section; and initiating a flow of fluid in the closed fluid flow system.

According to the teachings of the present invention the deploying the first solid screen blocking element and the deploying the second solid screen blocking element is implemented such that the first solid screen blocking element and the second solid screen blocking element are deployed so as to substantially circumscribe a planar solid area of an elbow of the ball trap screen.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is blocking elements for ball trap screens that enhance the movement of the cleaning ball through the ball trap in a closed fluid flow system.

The principles and operation of blocking elements for ball trap screens according to the present invention may be better understood with reference to the drawings and the accompanying description.

Figure 1:
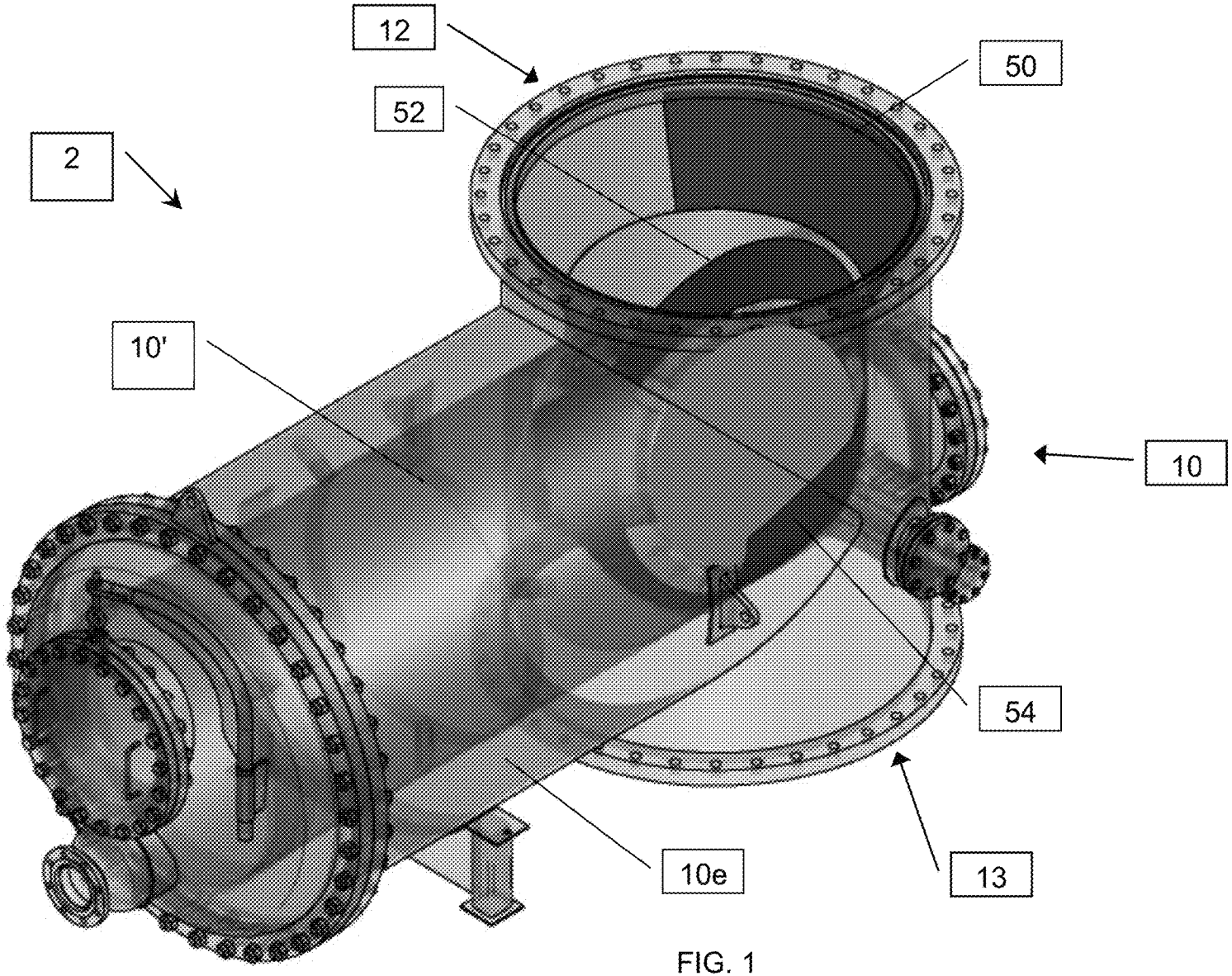
FIG. 1 is a transparent isometric view of a "T" type ball trap shown with a ball trap screen, constructed and operational according to the teaching of the present invention, deployed inside the ball trap housing.
Figure 2:
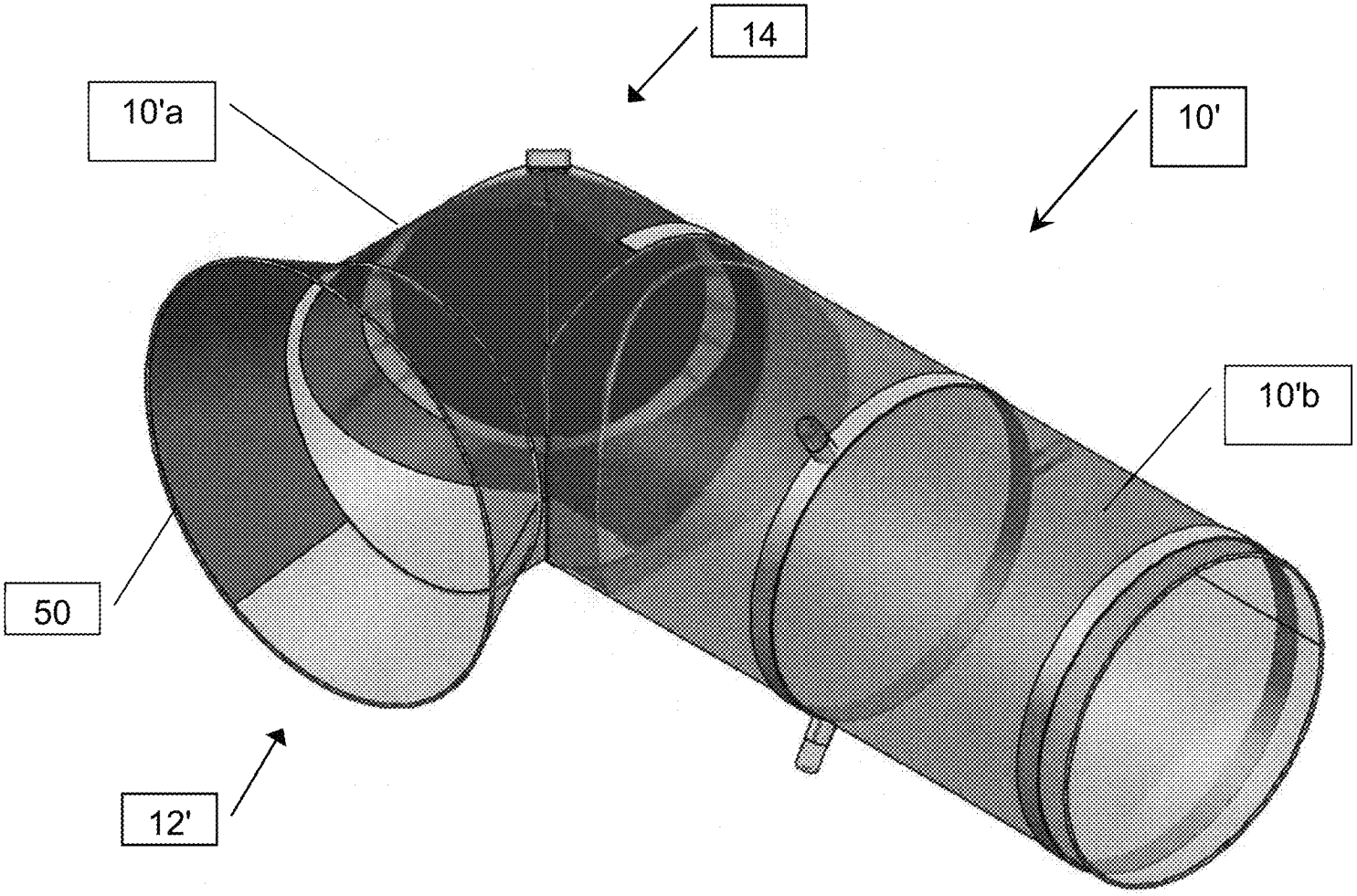
FIG. 2 is a transparent isometric top side view of the ball trap screen of FIG. 1.
Figure 3:
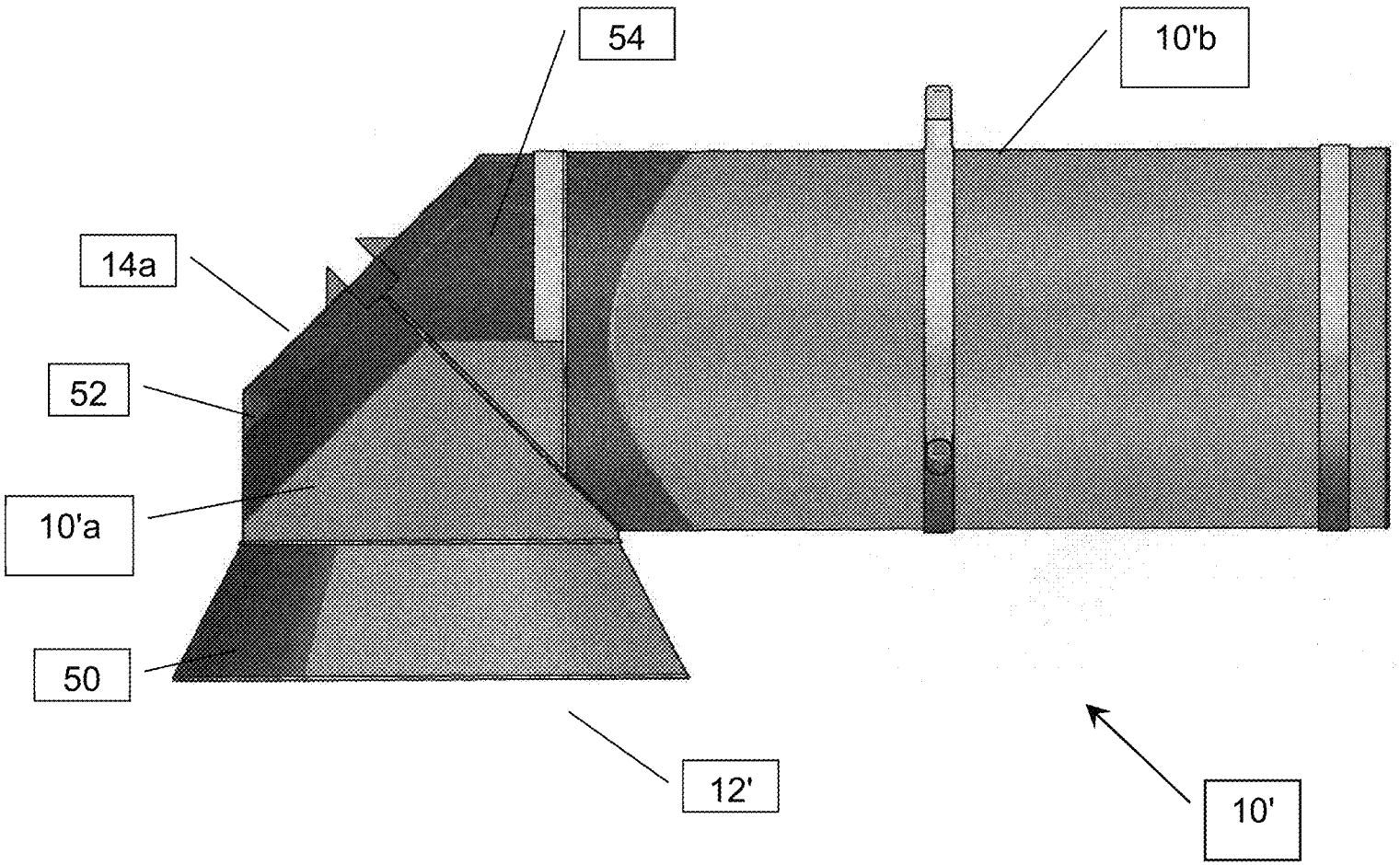
FIG. 3 is a transparent side view of the ball trap screen of FIG. 1.
Figure 4:
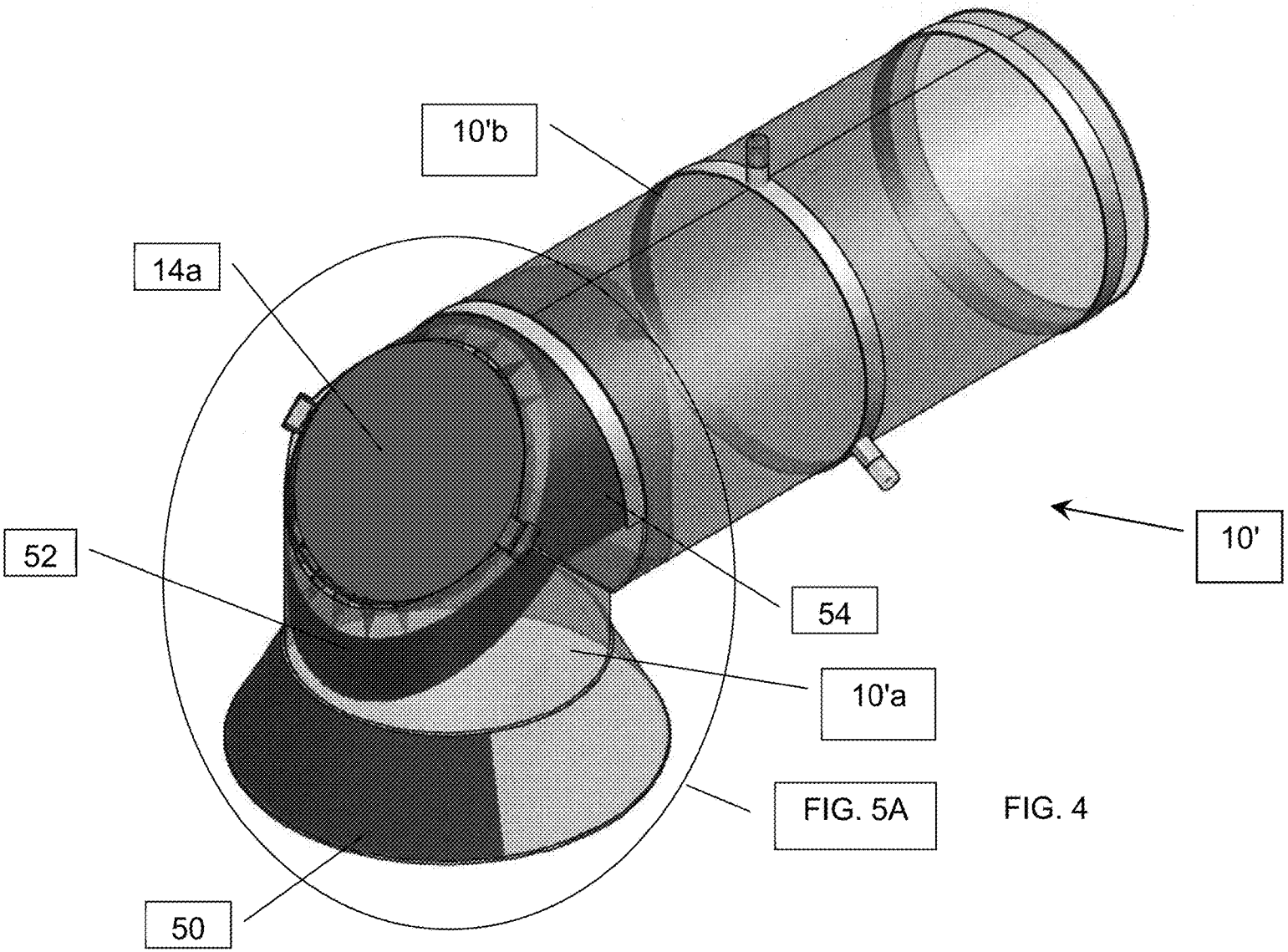
FIG. 4 is a transparent isometric bottom side view of the ball trap screen of FIG. 1.
Figure 5B:
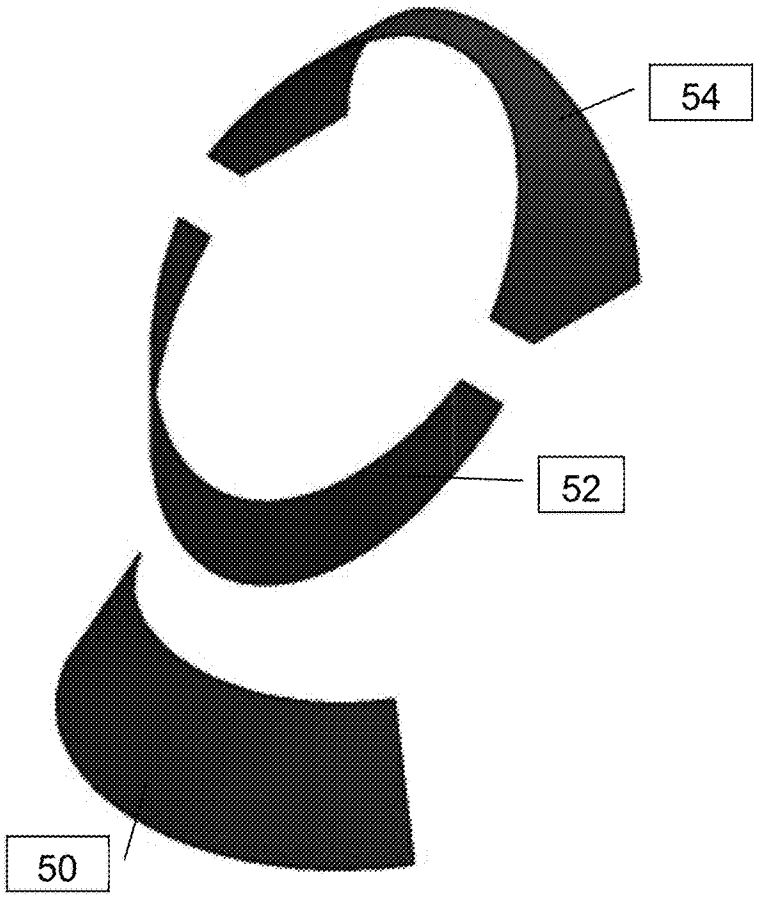
FIG. 5B is a detail of the blocking elements of FIG. 5A.
Figure 5A:
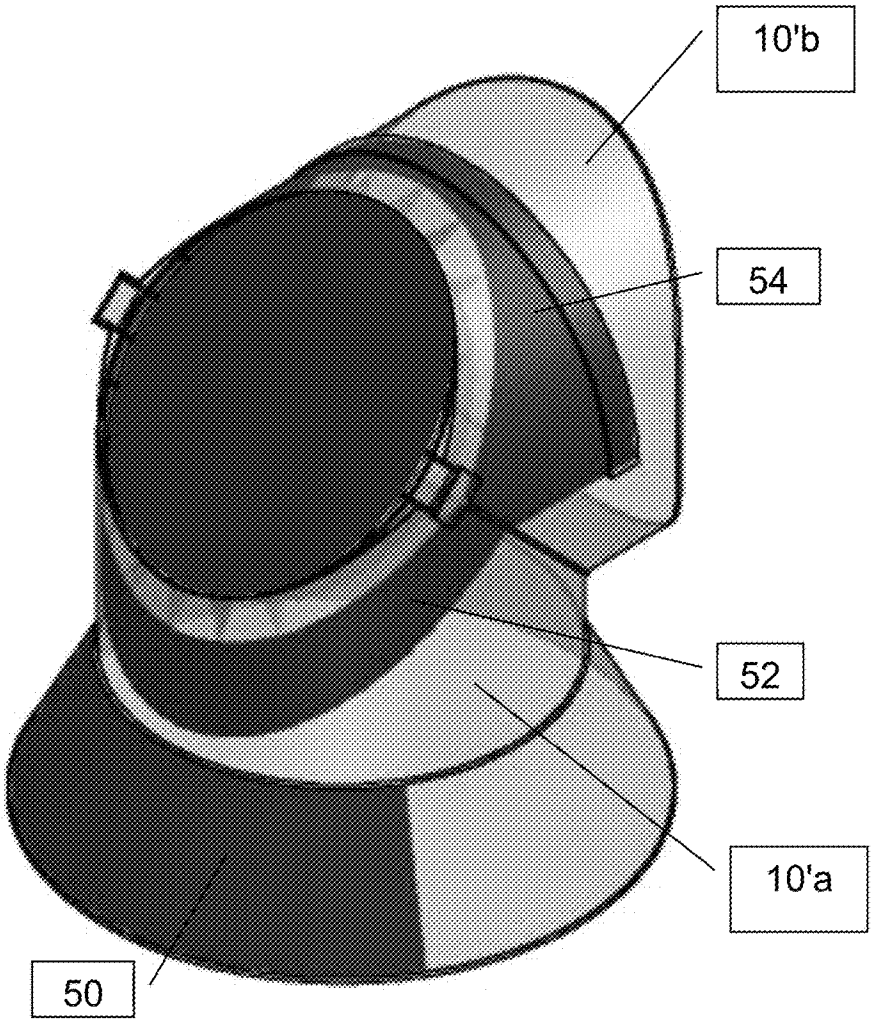
FIG. 5A is a detail a portion of FIG. 4.

Referring now to the drawings, FIG. 1 illustrates a transparent view of a "T" type ball trap 2 having a ball trap housing 10 with a water inlet opening 12, a water outlet 13 and a ball trap extension 10*e*. Also shown is a ball trap screen 10' deployed inside the ball trap housing 10. It is understood that in such ball traps, the main fluid flow path is between water inlet opening 12, a water outlet 13 and that the cleaning balls are directed into the ball trap extension by means of a minor fluid flow path.

As mentioned above, the present inventors sought a solution to the problem of fluid flow patterns in the "T" type ball traps currently in use causing some of the cleaning balls to congregate in regions of the ball trap screen such that the cleaning balls are not drawn out of the ball trap into the ball collection chamber. The present invention is the solution to that problem.

The ball trap screen 10' is configured with a cone shaped inlet 12' that tapers inward and connects to a first screen section 10'*a* of the ball trap screen 10'. The first screen section 10'*a* extends from the inlet to an elbow with a second screen section 10'*b* of the ball trap screen extending from the elbow 14 into the ball trap extension 10*e* that serves to connect the first 10'*a* and second 10'*b* screen sections. The ball trap screen 10' illustrated here is configured with a 90° elbow 14.

The present inventors have found that by deploying solid blocking elements on at least a portion of the cone shaped inlet 12' and on the 90° elbow 14 as illustrated in the drawings, the fluid flow patterns within the ball trap are changed sufficiently enough that the cleaning balls are directed to regions of the ball trap screen such that the cleaning balls are drawn out of the ball trap into the ball collection chamber.

It should be understood that the term "solid" is used herein to describe a solid closed surface uninterrupted by spaces or holes. The terms "block" and "blocking" are used herein to describe completely stopping the passage of fluid through an underlying or overlaying portion of the ball trap screen.

Therefore, the phrases "solid blocking elements" and "solid screen blocking elements" are used herein to describe components of the present invention having a solid closed surface uninterrupted by spaces or holes so as to stop and/or completely block fluid flow through the portion of the ball trap screen underlying or overlaying the entire region of the ball trap screen upon which the component is deployed so as to direct the fluid flow into the ball trap extension.

While the drawings herein are intended as illustrations of a preferred embodiment of the solid screen blocking elements of the present invention, it will be readily understood that the size, shape and exact placement of the solid blocking elements on the ball trap screen may be varied within the scope of the present invention.

That said, the present inventors have found that the preferred placement of the cone solid blocking element 50 is on the region opposite the 90° ball trap extension 10*e*. Preferably, but not necessarily, the cone solid blocking element 50 is configured to cover thirty percent of the circumference of the cone shaped inlet.

As illustrated herein at least a portion of the 90° elbow 14 includes a substantially planar solid area 14*a* configured so as to block fluid flow through the ball trap screen across all of the planar area. The planar solid area 14*a* is configured at substantially 45° to both the first 10'*a* and second 10'*b* screen sections. It will be readily understood that substantially planar solid area 14*a* also lies at substantially 45° to the fluid flow path between water inlet opening 12 and water outlet 13 of the ball trap housing 10. The present inventors have found that extending the solid area surrounding area 14*a* further enhances the fluid flow patterns within the ball trap so as to better direct the cleaning balls to regions of the ball trap screen such that the cleaning balls are drawn out of the ball trap into the ball collection chamber. To that end, first solid screen blocking element 52 and second solid screen blocking element 54 are deployed on the first 10'*a* and second 10'*b* screen sections respectively so as to substantially circumscribe solid area 14*a* and completely block fluid flow through the ball trap screen corresponding to the entire regions of their respective deployment. That is, the regions of the ball trap screen directly underlying or overlaying the solid blocking elements.

It should be noted that an innovation of the present invention is a method of enhancing the movement of the cleaning ball through the ball trap of in a closed fluid flow system, once fluid flow is initiated, by blocking portions of the ball trap screen so as to modify the fluid flow through the ball trap.

A further innovation of the present invention is the deployment of the solid blocking elements on the ball trap screen. It should be noted that each of the solid blocking elements are individually formed and such deployment may be done at the time of fabrication of the ball trap screen. Alternatively, the solid blocking elements may be configured integrally with the screen. That is, the screen itself may be fabricated with solid areas that completely block fluid flow through specific regions of the ball trap screen such that upon fabrication of the ball trap screen element, the location of the solid areas of the screen material correspond to the preferred locations of solid blocking elements 50, 52 and 54.

It will be appreciated that solid blocking elements may alternatively be fabricated independently for installation as aftermarket components for use in retro-fitting existing ball traps used in closed fluid flow systems.

It will be appreciated that the above descriptions are intended only to serve as examples and that many other embodiments are possible within the spirit and the scope of the present invention.

What is claimed is:

1. A ball trap screen for use with "T" type ball traps having a ball trap extension, the ball trap screen comprising:

(a) a cone shaped inlet;

(b) an elbow, at least a portion of which includes a substantially planar solid area configured so as to block fluid flow through the ball trap screen across all of said planar solid area;

(c) a first screen section extending between said cone shaped inlet and said elbow; and (d) a second screen section extending from said elbow into the ball trap extension;

wherein at least a portion of said cone shaped inlet includes a cone solid blocking element, said first screen section includes a first solid screen blocking element and said second screen section includes a second solid screen blocking element wherein said cone solid blocking element, said first solid screen blocking element and said second solid screen blocking element are configured so as to block fluid flow through corresponding regions of the ball trap screen, wherein the substantially planar solid area forms a portion of a housing of the elbow.

2. The ball trap screen of claim 1, wherein said elbow is configured as a 90° elbow.

3. The ball trap screen of claim 1, wherein said first solid screen blocking element and said second solid screen blocking element are deployed so as to substantially circumscribe said planar solid area of said elbow.

4. The ball trap screen of claim 1, wherein said cone solid blocking element, said first solid screen blocking element and said second solid screen blocking element are integrally formed with the ball trap screen.

5. The ball trap screen of claim 1, wherein said cone solid blocking element, said first solid screen blocking element and said second solid screen blocking element are individually formed and deployed on the ball trap screen.

6. The ball trap screen of claim 1, wherein the substantially planar solid area is configured to always remain stationary relative to other portions of the ball trap screen during use of the ball trap screen.

7. The ball trap screen of claim 1, wherein the substantially planar solid area extends from the first solid screen blocking element to the second solid screen blocking element.

8. The ball trap screen of claim 1, wherein the substantially planar solid area is radially external to the fluid flow.

9. Blocking elements for a ball trap screen, the blocking elements comprising:

(a) a cone solid blocking element configured for deployment on a cone shaped inlet of the ball trap screen, so as to block fluid flow through a corresponding region of the ball trap screen;

(b) a first solid screen blocking element configured for deployment on a first screen section of the ball trap screen, so as to block fluid flow through a corresponding region of the ball trap screen;

(c) a second solid screen blocking element configured for deployment on a second screen section of the ball trap screen, so as to block fluid flow through a corresponding region of the ball trap screen, and (d) an elbow, at least a portion of which includes a substantially planar solid area configured so as to block fluid flow through the ball trap screen across all of said substantially planar solid area, the substantially planar solid area forming a portion of a housing of the elbow.

10. The blocking elements of claim 9, wherein said first solid screen blocking element and said second solid screen blocking element are configured for deployment so as to substantially circumscribe the planar solid area of an elbow of the ball trap screen.

11. A method of enhancing the movement of a cleaning ball through a ball trap of a closed fluid flow system by blocking a flow of fluid through portions of a ball trap screen deployed within a ball trap housing so as to modify the fluid flow through the ball trap, the method comprising:

(a) deploying a cone solid blocking element on a cone shaped inlet of the ball trap screen, said cone solid blocking element configured so as to block fluid flow through a corresponding region of said cone shaped inlet;

(b) deploying a first solid screen blocking element on a first screen section of the ball trap screen, said first solid screen blocking element configured so as to block fluid flow through a corresponding region of said first screen section;

(c) deploying a second solid screen blocking element on a second screen section of the ball trap screen, said second solid screen blocking element configured so as to block fluid flow through a corresponding region of said second screen section; and (d) initiating a flow of fluid in the closed fluid flow system, wherein said deploying said first solid screen blocking element and said deploying said second solid screen blocking element is implemented such that said first solid screen blocking element and said second solid screen blocking element are deployed so as to substantially circumscribe a planar solid area of an elbow of the ball trap screen, the planar solid area forming a portion of a housing of the elbow.

* * * * *